United States Patent [19]

Tuntland

[11] Patent Number: 5,058,642

[45] Date of Patent: Oct. 22, 1991

[54] GOLF BAG COVER

[76] Inventor: Martell F. Tuntland, 9059 103rd Ave., Sun City, Ariz. 85351

[21] Appl. No.: 599,643

[22] Filed: Oct. 18, 1990

[51] Int. Cl.[5] ..... A63B 55/00; A63B 57/00

[52] U.S. Cl. ..... 150/159; 206/315.4

[58] Field of Search ..... 150/159, 160; 206/315.2-315.9; 248/96

[56] References Cited

U.S. PATENT DOCUMENTS

| | | | |
|---|---|---|---|
| 1,555,035 | 9/1925 | Stevens | 206/315.6 |
| 2,631,232 | 6/1954 | Womack | 206/315.4 X |
| 2,704,563 | 3/1955 | Henrich | 150/159 |
| 2,747,636 | 5/1956 | Couture | 150/160 |
| 2,752,973 | 7/1956 | Stamp | 206/315.6 |
| 3,053,298 | 9/1962 | Stamp | 206/315.6 X |
| 3,913,648 | 10/1975 | Sessler | 206/315.4 |
| 3,977,451 | 8/1976 | Duba | 206/315.4 |
| 4,173,241 | 11/1979 | Stock | 206/315.6 |
| 4,200,133 | 4/1980 | Whitlow | 150/159 |
| 4,234,025 | 11/1980 | Berge | 206/315.4 |
| 4,453,632 | 6/1984 | Clower | 206/315.4 |
| 4,498,579 | 2/1985 | Brick | 206/315.4 |
| 4,699,164 | 10/1987 | Pilney et al. | 206/315.4 X |
| 4,752,004 | 6/1988 | Very | 206/315.4 X |
| 4,953,697 | 9/1990 | Stanley | 150/159 X |

FOREIGN PATENT DOCUMENTS

| | | | |
|---|---|---|---|
| 1230580 | 5/1971 | United Kingdom | 206/315.3 |

*Primary Examiner*—Sue A. Weaver

*Attorney, Agent, or Firm*—Emrich & Dithmar

[57] ABSTRACT

An impermeable golf bag cover is fabricated from a flexible, transparent and impermeable material to protect the interior of the golf bag and the enclosed clubs from inclement weather when a club is being removed from the bag or replaced into the bag. The lower bottom portion of the golf bag portion is used both to secure the cover to the open top of a golf bag while the remaining portion of the lower bottom portion serves as an access portion to the interior of the golf bag and its contents. An extended tubular upper portion of the cover is integral to the lower bottom portion and has sufficient length to accept a golf club during the procedure of its removal from or replacement into the golf bag.

20 Claims, 2 Drawing Sheets

FIG. 1
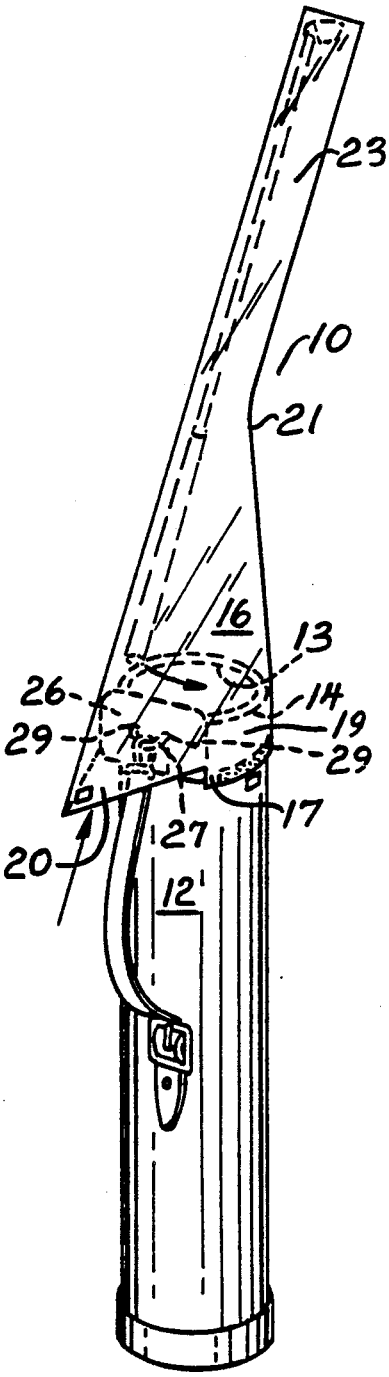
FIG. 3
FIG. 2
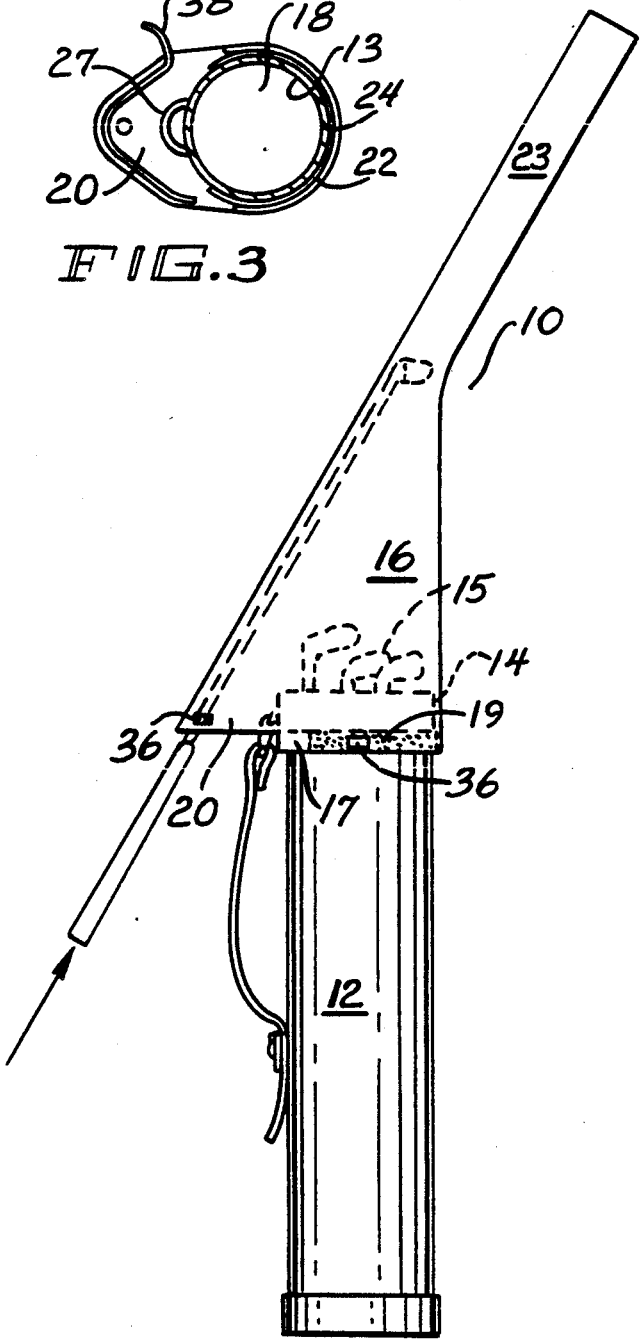
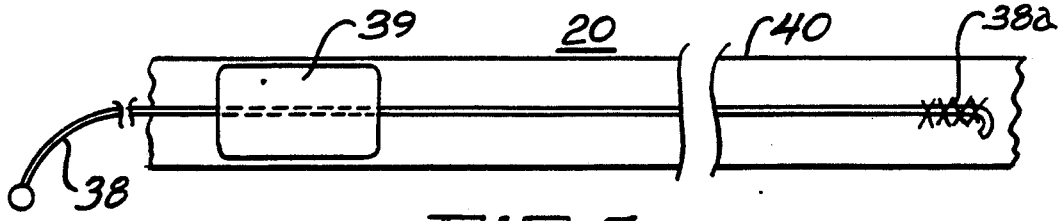
FIG. 7

GOLF BAG COVER

BACKGROUND OF THE INVENTION present invention relates to a golf bag cover for selective attachment to a golf bag to permit removing from and placing into the bag a golf club while protecting the club and the bag from inclement weather.

Many golf bag covers and designs have been developed to protect the clubs in a golf bag from rain and other inclement weather both during periods when the golf bag is in use and during the time when a golfer is actively playing a game of golf in inclement weather.

Examples of such golf bag cover which include openings through the cover to permit access to the golf clubs are disclosed in U.S. Pat. Nos. 4,752,004; 4,498,579; 4,234,025 3,977,451; 4,200,133 and 2,704,563. In each of these designs, the protective cover is generally transparent, to permit viewing of the club to be selected from the bag. In each of these designs an opening or access is provided in the cover at or near the upper portion of the cover to permit the removal from and or the replacement of the golf club into the bag. However, such designs permit moisture to enter through the openings into the interior of the bag during usage. Over the lengthy time period during which a golf game is played in the rain, each time a golf club is required from the interior of the bag, the clubs and bag are exposed to the elements, once for removal and once for replacement of the club, situation which ultimately result in the clubs and grips becoming wet and unusable.

Also, in some designs of the bag covers, the golf club access opening is in a permanent upward position in the cover so that even through some temporary non-continuous covered protection is provided, a lengthy rain period results in leakage, thus allowing moisture to enter the bag even when not removing or replacing golf clubs.

In other protective covers for golf bags which do not include access openings in the cover, the entire cover or a portion of the cover must be lifted to permit access to a golf club. Examples of this type of design are provided in U.S. Pat. Nos. 2,704,563; 1,555,035, 4,498,579, 3,913,648, 4,699,164 and 4,453,632. Again, continued usage in inclement conditions of such protective covers results in the clubs and grips becoming unusable by the golfer.

Accordingly, the golf club covers heretofore known in the art simply do not maintain the clubs and grips in a substantially dry condition free of the inclement weather. This unsatisfactory condition results from the fact that such known prior art covers expose the clubs and golf bag to the inclement weather during the removal from and insertion of the club into the bag.

SUMMARY OF THE INVENTION

It is one object of the present invention to provide a continuous protective covering over the interior of the golf bag and the golf clubs during all periods of play during inclement weather.

It is a further object of the present invention for the protective covering to be transparent, flexible, and impervious to inclement weather to prevent the clubs in the bag from becoming wet and unusable.

It is still another object of the present invention to provide access to any golf club in the golf bag, thereby permitting any selected club to be removed from or replaced into the golf bag without moisture reaching any of the remaining clubs during the access procedure.

It is another object of the present invention to provide a cover having an attachment portion which is releasably mounted to the golf bag and an access portion which includes a drawstring member which permits closure of the access portion to seal the bag and clubs from inclement weather.

It is yet another object of the present invention to provide a lightweight cover for a golf bag having viewing windows therein to permit the ready selection of a club from the bag.

The present invention discloses a golf bag hood or cover having a continuous waterproof covering for its entire upper portion. Transparent and flexible materials, such as, vinyl, nylon or polyethylene are acceptable lightweight materials for the hood or cover that make it easy for the golfer to identify the selected club or clubs in the bag and also to permit folding of the hood or cover into a compact package for storage when not in use.

The bottom portion of the golf bag cover has the form of a truncated shaped cone when expanded to its full volume capability or capacity. The lower end of the bottom portion of the hood is open and a portion of the lower end is adapted for attachment to the open end of the golf bag while an equal or greater portion of the hood's lower end opening is utilized as an access opening or port to permit the golfer to reach into to remove from and replace any selected golf club into the bag. The upper portion of the bottom portion of the hood tapers into an upper hood portion that has the form of a hollow cylinder or tube, with a closed upper end when expanded to its full volume capability or capacity. The bottom portion and upper portion of the cover are of sufficient length and cross-sectional area to accept a golf club's full length above the top of the golf bag.

The golfer, while playing in inclement weather, may easily and readily select the desired club by viewing the club either through the transparent golf bag cover or the window or windows in the cover and then reaching past the open lower access portion between the hood wall and the golf bag to grasp the selected club. The club is pushed upwards into the hollow upper tubular portion of the golf bag cover until the club grip is clear of the golf bag top. The club by its grip is then pulled away from the bag and lowered out through the lower open access portion of the hood. To replace the selected club back into the bag, the above procedure is reversed, with the club's head being pushed up into the lower access part of the hood and then further upwards into the hood's upper tubular portion until the club's grip can clear the top of the golf bag. The club is then lowered into position inside the golf bag.

The extended upper tubular portion of the golf bag hood generally hangs in a vertical downward position when not being utilized for its intended purpose of providing a protected space inside the golf cover during the procedure of removing and replacing the selected golf club, when the tubular portion is in a raised upward position.

The present invention consists of certain novel features and structural details hereinafter fully described, illustrated in the accompanying drawings, and particularly pointed out in the appended claims, it being understood that various changes in the details may be made without departing from the spirit and scope thereof or sacrificing any advantages of the present invention.

BRIEF DESCRIPTION OF THE DRAWINGS

FIG. 1 is a perspective view of a tunneling golf bag cover in accordance with the present invention attached to a golf bag illustrating the full extended position of the golf bag cover permitting enclosure of a golf club and bag during either removal from or replacement of the club into the golf bag;

FIG. 2 is a side view of a tunneling golf bag cover in accordance with the present invention attached to a golf bag illustrating the midway position of either removal from or replacing a golf club into the golf bag;

FIG. 3 is a cross-sectional view of the upper end of the golf bag, illustrating one embodiment for closing the access portion of the golf bag;

FIG. 7 is an enlarged cross-sectional view illustrating the positioning of the drawstring member in the hem of the access portion in accordance with the present invention.

DETAILED DESCRIPTION OF THE PREFERRED EMBODIMENT

Figure 4:
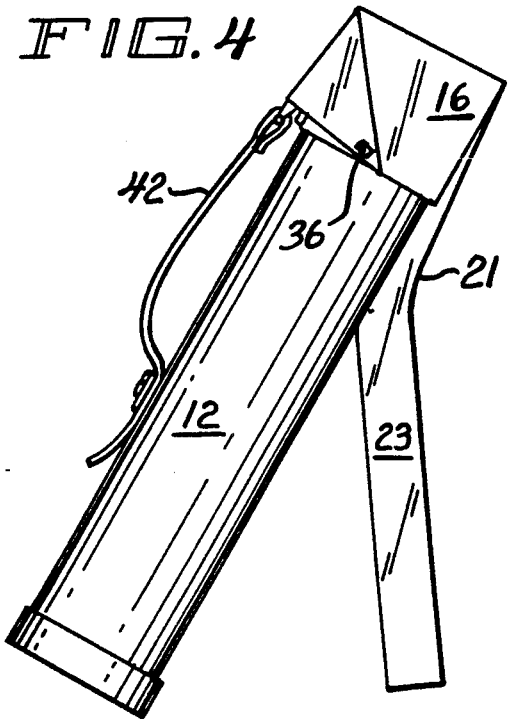
FIG. 4 is a perspective view of the tunneling golf bag cover in accordance with the present invention illustrating the collapsed position of the golf bag cover when attached to a golf bag.

For the purpose of facilitating an understanding of the scope of the present invention, illustrated in the drawings of the embodiments of the present invention, like numerals have been used throughout the several views to designate the same or similar parts. Referring now to FIGS. 1–4, the tunneling golf bag rain hood or cover 10 is shown attached to the upper end portion 14 of a golf bag 12, which defines an end opening 13 in the golf bag 12. As shown in FIGS. 1–3, one means of attachment of the golf bag cover 10 to the bag 12 is by the use of either hook or latch members 22 on the inside of the cover which engage either latch or hook members 24 on the outside of the bag 12. Specifically, as shown on FIG. 1, the golf bag cover 10 is comprised of two parts, preferably, integral to one another. The lower bottom portion 16 is generally in the form of a truncated shaped cone when expanded to its full volume capability or capacity. The lower end 17 of the lower bottom portion 16 of the cover 12 defines an opening 18 which serves a dual purpose, as well hereinafter be described. The upper end 21 of the lower bottom portion 16 is tapered and extends continuously in tubular shaped form to provide a closed end upper portion 23. The junction between the upper end 21 of the lower bottom portion 16 and the closed end upper portion 23 is, preferably, shown as an obtuse angle, which facilitates withdrawal from and insertion of a club into the bag. However, it is clearly within the scope of the present invention that the lower bottom portion 16 and the closed end upper portion 23 are integral to one another and are mounted on the same axis to one another.

Figure 5:
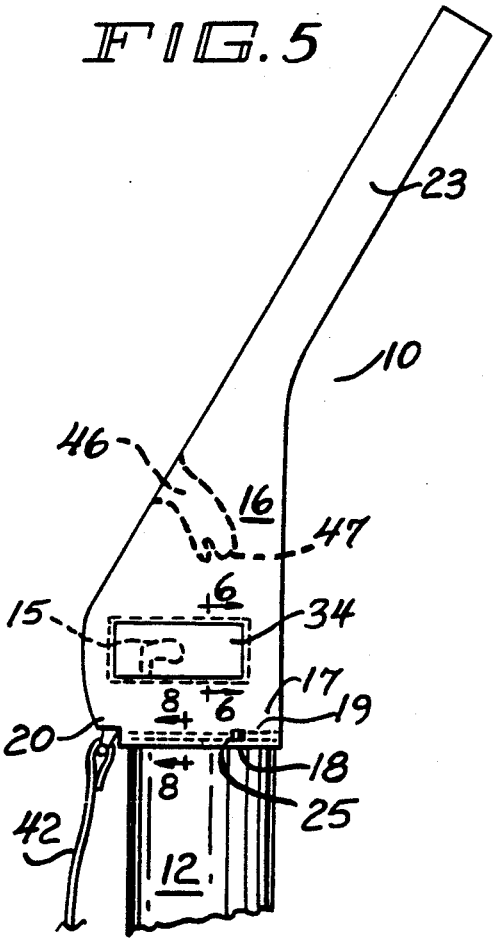
FIG. 5 is an enlarged side view of the tunneling golf bag cover in accordance with a further embodiment of the present invention attached to a golf bag illustrating the full extended position of the golf bag cover to permit viewing the clubs in the bag for either removal from or replacement of the club into the golf bag.
Figure 6A:
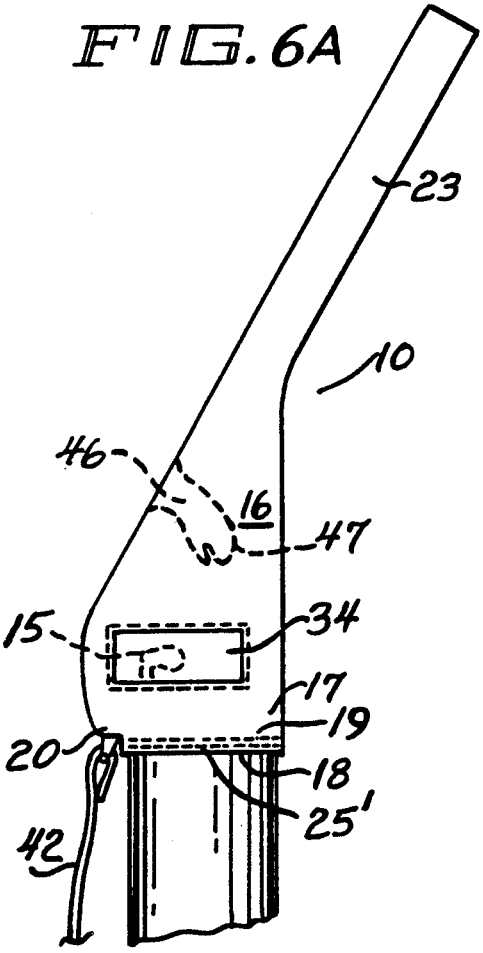
FIG. 6A is an enlarged side view of the tunneling golf bag cover in accordance with a further embodiment of the present invention.
Figure 8:
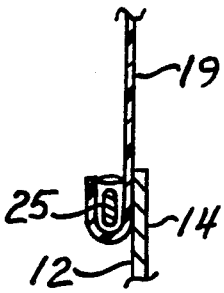
FIG. 8 is a cross-sectional view taken along lines 8—8 in FIG. 5.

The opening 18 at the lower edge of the bottom portion 16 defines an attachment portion 19 which provides for temporary attachment of the cover 10 to the bag 12 and an access portion 20 which permits access by the golfer to the clubs in the bag. As shown in FIG. 3, the inside surface of the lower edge of the attachment portion 19, preferably, includes either hook or latch members 22 which comprise hook and loop fastener material such as VELCRO and are mounted thereon which engage latch or hook members 24 mounted on the outside of the end portion 14 of the golf bag 12 to firmly and releasably secure the cover 10 to the bag. The remaining portion of the opening 18 constitutes an access portion 20 which permits access by the golfer to the interior of the cover to remove from and replace a club into the golf bag, as shown in FIGS. 1–2. In accordance with one embodiment illustrated in FIGS. 2 and 4, for example, the access portion 20 for the bag includes hook and latch members indicated at 36, FIG. 2 illustrating the open condition for the cover and FIG. 4 illustrating the closed condition for the cover with hook and latch members 36 overlying one another. As shown in FIGS. 3–7, the lower hem or edge of the access portion 20, preferably, includes a drawstring or puckerstring member 38 mounted therein which permits the golfer to collapse the access portion about the top of the bag from the open or access position (FIGS. 1–3) to the collapsed position, as shown in FIG. 5. Additionally, it is within the scope of the present invention that a belt and buckle member 25 may be utilized to tighten the attachment portion 19 around the upper end portion 14 of the golf bag 12 to firmly and releasably attach the cover 10 to the bag, as shown in FIGS. 5 and 8. Also, the fastening means may be a continuous elastic band 25 sewn into the seam which engages the attachment portion 19 to releasably hold the cover about the golf bag as illustrated in FIG. 6A.

It is preferred that the access portion 20 includes a drawstring member 38 attached to the lower hem of the access portion, as shown in FIGS. 3 and 7. When the cover is in place about the bag, the drawstring member 38 is pulled to collapse the access portion of the lightweight nylon cover about the top of the bag, the position as shown in FIG. 5. When it is desired to select a club from the bag, the golfer grasps the access portion and pulls the tucked nylon cover material to the open position to permit access to the club, the open position as illustrated in FIGS. 1–3. FIG. 7 illustrates the anchoring of the drawstring member 38 in the lower hem 40 of the access portion 20. The drawstring member is anchored at 38*a* at one end of the lower hem of the access portion and allowed to pass through a guide member 39, which is fixedly mounted and anchored at the other end of the lower hem. Additionally, the attachment portion 19 of the cover 10 may include snap devices mounted thereon which cooperate with snap devices mounted on the upper end portion 14 of the bag to secure the cover to the bag.

The cover and bag combination, may include a flexible plastic rain shield 26 which is adapted to be mounted onto the metal ring 27 on the bag 12 to provide a separation between the access portion 20 and the attachment portion 19 of the cover and to prevent any rain and the like from penetrating onto the clubs 15 in the bag during removal from or replacement of a club into the bag, as shown in FIG. 1. The rain shield includes two channelled openings 29 which correspond to the width of the metal ring 27 to permit engagement and mounting of the shield to the ring on the bag. The rain shield assists in preventing rain from penetrating into the bag during severe inclement weather.

Figure 6:
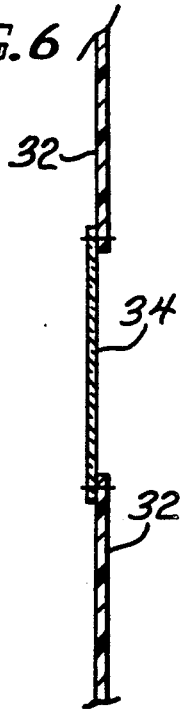
FIG. 6 is a cross-sectional view taken along lines 6—6 in FIG. 5.

The cover 10 may be comprised of a flexible clear material such as vinyl or polyethylene. Such materials permit the golfer to visually select a club from the bag while preventing inclement weather from penetrating onto the clubs 15 in the bag. Such a configuration is shown in FIGS. 1–4. However, when the cover is composed of flexible or synthetic material, such as nylon, that is substantially impervious to the elements, the cover 10 may be constructed as shown in FIGS. 5 and 6. The cover 10 comprised of nylon or synthetic material 32 includes at least one flexible transparent window 34 sewn into at least the bottom portion 16, to permit the golfer to visually select a club from the bag, as shown in FIG. 6. The window-nylon cover combination permits the selection of a colored cover to match the bag color, as desired, and readily permits folding and storage of the cover when it is not in use.

Referring now the drawings, the description of the construction features of cover 10 and the procedure for employing these features for the removal or replacement of a selected club 15 while protecting the inside of bag 12 and the remaining golf clubs 15 from the weather elements may be described as follows.

When a golfer is playing a golf game during inclement weather, a typical position of the golf bag 12 and cover 10 is shown in FIG. 4 as being carried either on a cart or by a caddy. Because the cover material is flexible, the closed end upper portion 23 of the cover is collapsed, approximating the form of an elongated rectangle hanging downward vertically towards the ground, as shown in FIG. 4. Also, as illustrated in FIG. 4, the upper end 21 of the bottom portion 16 of the cover is in a partially collapsed, flattened, and natural downward hanging folded position. Protection of the clubs 15 from inclement weather is provided by the cover in either the positions of FIG. 1 or FIGS. 4–5 because the cover material is continuous and closed to the weather except for the cover's access portion 20 where the opening is positioned downward, shedding moisture from above, as shown in FIGS. 1, 3 and 5. And it may be desired to utilize hook and latch members 36 on the outside of the lower end portion to secure the access portion tightly about the bag, as shown in FIG. 4.

When the time comes to select a club, the golf bag 12 is in a position similar to that shown in FIG. 5. Either the hook and latch member 36 (FIG. 4) on the access portion 20 is released or the drawstring member 38 (FIG. 7) is released thereby opening the access portion 20 to the open position as illustrated in FIGS. 1 and 2. The golfer views the selected club 15 through the transparent viewing cover, made of clear, flexible material (FIGS. 1–4) or through the viewing window 34 (FIGS. 5–6) and reaches his arm up and inside the access portion 20 of the cover 10, thus changing the form of the cover from a partially collapsed truncated shaped cone configuration to that of a expanded truncated shaped cone. The golfer then grips the selected club 15, and raises it upwards, guiding the selected club out of the bag 12 while the closed end upper portion 23 of the cover follows the upward path of the selected club changing its form with the passage of the club from that of a collapsed flattened rectangle to that approximating a sealed hollow cylinder. When the grip of the selected club 15 has cleared the top edge 14 of the bag 12, the club is guided downward through the hood's access portion 20 until it is completely clear of the bag and cover. As the club is lowered out of the cover, the form of the hood's upper closed end reverts back to approximate a collapsed rectangle that hangs vertically downward, while the cover's lower bottom portion reverts back to its downward changing, partially collapsed flattened truncated shape cone.

To replace the selected club back into the golf bag 12, the above procedure and steps are reversed. First, the club is inserted into the access portion 20 bottom and guided upwards into the hood's elongated closed and upper portion 23 and the club 15 is lowered back into the golf bag 12. Again, the access portion 20 is closed to prevent any rain from penetrating to the clubs, as shown in FIG. 5.

The tunneling golf bag cover 10 may be fabricated from a single pre-set sheet of material folded over along the left hand straight edge of the closed end upper portion and lower bottom portion and permanently sealing, by welding or gluing, the edges together. The lower end 17 of the cover 10 are not joined together, but left permanently open. The means of attaching the cover to the golf bag 12 is fabricated into the two sheets of material along the lower end 17, as shown in FIG. 3. The approximate dimension of the golf bag cover will readily fit the majority of golf bags and golf clubs contained therein.

What has been disclosed is a golf bag cover that has particular application for mounting onto a bag carried by a golf cart. When the golf bag is carried over the left shoulder by a golfer, it should be understood that the positioning of the cover 10 with respect to the bag should be opposite to that shown, for example, in FIG. 5. That is, the access portion 20 should be on the side opposite where the strap 42 is attached to the bag to permit the golfer to have ready access to the clubs in the bag.

It has even been found that when the bag is carried on the shoulder, it is desirable to provide a sleeve 46 with a mitt-type fitting 47, corresponding to a hand, to permit the golfer to select a club and assist in its removal from within the cover. As shown in FIG. 5, the sleeve-mitt member permits the golfer to use the hand to select the club and assist in removal from within the cover.

I claim:

1. An elongated rain cover for protecting the interior of a golf bag and its clubs while permitting access thereto, comprising:

a closed end upper tubular portion, said closed end upper portion being fabricated of a flexible, transparent and moisture impermeable material and having the form when expanded to its full capacity of a hollow cylinder;

a lower bottom portion comprised of an attachment portion and an access portion, said lower bottom portion fabricated of a flexible, transparent and moisture impermeable material and having the form, when expanded to full capacity of a hollow truncated shaped cone, with said closed end upper portion and said lower bottom portion being integral with one another; and a golf bag fastening means secured to said attachment portion of said lower bottom portion for mounting said cover to the golf bag, with said access portion permitting access to the clubs in the bag.

2. The rain cover of claim 1 wherein the transparent, flexible, and moisture impermeable material in vinyl.

3. The rain cover of claim 1 wherein the transparent, flexible, and moisture impermeable material is polyethylene.

4. The rain cover of claim 1 wherein said cover is fabricated of a single sheet of flexible, transparent, and substantially moisture impermeable material.

5. The rain cover of claim 1 wherein said fastening means are hook and latch members.

6. The rain cover of claim 1 wherein said fastening means is a belt and buckle member secured to a portion of said open lower end of said attachment portion.

7. The rain cover of claim 1 wherein said access portion includes a releaseable drawstring member mounted therein operable to permit closure of the access portion about the golf bag to prevent rain from penetrating into the bag and operable to permit opening of the access portion when a club is removed from or replaced into the bag.

8. The rain cover of claim 1 wherein said golf bag fastening means is a continuous elastic band secured to said attachment portion of said open lower end of said lower bottom portion for mounting said cover to the golf bag.

9. The rain cover of claim 1 wherein said lower bottom portion and said closed end upper portion are orientated at an obtuse angle with respect to one another to facilitate withdrawal or replacement of the club into the bag.

10. The rain cover of claim 1 wherein said access portion comprises a sleeve having a mitt-type fitting to facilitate selection of a club and removal of a selected club from within the cover.

11. An elongated rain cover for protecting the interior of a golf bag and its clubs while permitting access thereto, comprising:

a closed end upper portion, said closed end upper portion being fabricated of a flexible, synthetic and moisture impermeable material and having the form when expanded to its full capacity of a hollow cylinder;

a lower bottom portion comprised of an attachment portion and an access portion, said lower bottom portion fabricated of a flexible, synthetic and moisture impermeable material and having the form, when expanded to full capacity of a hollow truncated shaped cone, with said closed end upper portion and said lower bottom portion being integral with one another with at least said lower bottom portion including window means for viewing the clubs in the bag; and a golf bag fastening means secured to said attachment portion of said lower bottom portion for mounting said cover to the golf bag, with said access portion permitting access to the clubs in the bag.

12. The rain cover of claim 11 wherein the synthetic, material is nylon.

13. The rain cover of claim 11 wherein the transparent window means is flexible, vinyl.

14. The rain cover of claim 12 wherein said window means is sewn into the nylon cover.

15. The rain cover of claim 11 wherein said fastening means are hook and latch members.

16. The rain cover of claim 11 wherein said fastening means is a belt and buckle member, secured to a portion of said open lower end of said attachment portion.

17. The rain cover of claim 11 wherein said golf bag fastening means is a continuous elastic band secured to said attachment portion of said open lower end of said lower bottom portion for mounting said cover to the golf bag.

18. The rain cover of claim 11 wherein said lower bottom portion and said closed end upper portion are orientated at an obtuse angle with respect to one another to facilitate withdrawal or replacement of the club into the bag.

19. The rain cover of claim 11 wherein said access portion includes a releaseable drawstring member mounted therein operable to permit closure of the access portion about the golf bag to prevent rain from penetrating into the bag and operable to permit opening of the access portion when a club is removed from or replaced into the bag.

20. The rain cover of claim 11 wherein said access portion comprises a sleeve having a mitt-type fitting to facilitate selection of a club and removal of a selected club from within the cover.

* * * * *